US005287842A

United States Patent [19]

Saunders

[11] Patent Number: 5,287,842

[45] Date of Patent: Feb. 22, 1994

[54] 3-PIECE CUSHION NOCKING POINT

[75] Inventor: Charles A. Saunders, Columbus, Nebr.

[73] Assignee: Saunders Archery Company, Columbus, Nebr.

[21] Appl. No.: 5,152

[22] Filed: Jan. 15, 1993

[51] Int. Cl.[5] ..... F41B 5/14

[52] U.S. Cl. ..... 124/91

[58] Field of Search ..... 124/90, 91

[56] References Cited

U.S. PATENT DOCUMENTS

| | | | |
|---|---|---|---|
| 3,937,205 | 2/1976 | Saunders | 124/91 |
| 4,909,233 | 3/1990 | Stephenson | 124/91 |
| 5,016,603 | 5/1991 | Tentler | 124/91 |

FOREIGN PATENT DOCUMENTS

| | | | |
|---|---|---|---|
| 3405319 | 6/1984 | Fed. Rep. of Germany | 124/91 |

*Primary Examiner*—Randolph A. Reese

*Assistant Examiner*—Anthony Knight

*Attorney, Agent, or Firm*—Michael G. Berkman

[57] ABSTRACT

There is described a nocking point assembly in which two differing plastics compositions are used in nocking point components. A softer, elastomeric first material physically engages the bowstring to provide enhanced, non-damaging gripping, while an oversleeved, second arrow-nock-contacting component of a harder plastics composition serves to ensure wear resistance in use. Each component is in the form of a hub-like disc with an integrally-joined tubular shank, the disc and the shank being slit to obviate any need to detach the bowstring when mounting the nocking point components. A separate split or open metallic ring is crimped in place over the intersleeved shanks to secure the assembly as a unit. The slits in the plastic elements, as assembled, are preferably misaligned and are staggered with the split in the locking ring to establish and preserve a round cross-sectional configuration.

8 Claims, 1 Drawing Sheet

3-PIECE CUSHION NOCKING POINT

FIELD AND BACKGROUND OF THE INVENTION

The present invention relates to a nocking point or nock set for attachment to an archery bowstring. More particularly, the invention is directed to a 3-piece cushion nocking assembly, nock set or nocking point which may easily and conveniently be firmly affixed in a selectable position on the bowstring of an archery bow.

The art is replete with nocking points of varying physical form and fabricated of different types of structural materials. Each device has the general purpose of defining a desired position for placement of the arrow nock preparatory to releasing the arrow. One example is a plastic lined clamp-type string nock mounted on the bowstring above the arrow to define the nocking point on the bowstring. A nock may also be mounted on a bowstring between a bowstring release device and the arrow. In still other arrangements nocking points are affixed above and below the nock on the bowstring, with yet another, or third nock, attached below a release device to prevent the release device from sliding along the bowstring.

As has been widely recognized and appreciated, a bowstring clamping nock should be formulated and fabricated so that the string-encircling structure is sufficiently elastomeric and resilient to ensure positive gripping while precluding physical damage to the bowstring itself. That is, the material gripping the bowstring must be relatively "soft", and resilient. However, the forces impressed on the string nock by the arrow nock (the bowstring engaging tip of the arrow) and by the release device may be damaging to string nocks composed of compositions formulated to meet the requirement of safeguarding the bowstring from clamping damage. Moreover, the material which embraces the bowstring must grip the string frictionally, while that part of the string nock which comes into abutting and stressing contact with the nock of the arrow is desirably characterized by low-friction, wear resistance, the markedly increased lubricity. String nocks of the prior art have failed effectively to deal with the challenging problem posed by the requirement, in a single device of the incongruous properties identified.

It is, therefore, a principal aim of the present invention to provide a simple and practical solution to the dilemma posed, and to ensure duo-functional optimization in the fabrication and use of string nocks for archery use. The present invention is believed to obviate important inadequacies and shortcomings of prior art devices.

SUMMARY OF THE INVENTION

The present invention provides, in a nocking point, an assembly in which two different non-metallic materials consisting of plastics compositions having different physical properties are utilized in a composite mechanical structure. A split metal clamping ring encircles the two plastics components and is crimped firmly to lock the assembly in place on the bowstring.

It is an important feature of the invention that the nocking point includes two separate and distinct cooperating structural components in addition to a metal crimping ring and that these two components are formulated of different compositions and exhibit significantly different mechanical properties.

An important advantage of the nocking point of the invention is that it includes first and second elements, each element including a hub-like disc, and each disc being integrally formed with tubular shank.

A related critical feature of the invention is that the shanks, which are intersleeved when positioned on the bowstring, are different in composition. The first or radially innermost of the sleeved shanks, being the shank that contacts and bears upon the bowstring, is of a resilient, high-friction elastomeric composition which safely and positively engages the bowstring, and is locked on or secured upon the bowstring without damage to the bowstring. The shank, as well as the disc of the second or outer of the intersleeved components is composed of a harder composition characterized by high lubricity and high wear resistance, to withstand repeated abutment contact against an arrow release device.

In a preferred embodiment of the invention the intersleeving components are each slotted longitudinally so that they may be positioned in place on the bowstring without any need to detach the string from the bow.

It is a related feature of the intersleeved shank components of the nocking assembly that the slits are purposely misaligned or staggered annularly to promote roundness in the final bandgripped sleeved shanks.

It is a feature of the three piece, cushion nocking point of the invention that in the final assembly the split in the metal clamping ring is staggered with respect to the slits in the intersleeved shanks of the assembly.

Yet another important feature of the invention is that the slots or slits in the shanks (and in the discs or hubs) of the bowstring-mounted nocking point assemblies are staggered 180° in relationship to each other so that no slot zone rubs against either the nock or any release device.

Other advantages and features of the invention will be evident from the following detailed description considered in conjunction with the drawings.

DETAILED DESCRIPTION OF ILLUSTRATED EMBODIMENT

The aims and objects of the invention are achieved by providing in a nocking point a unique three-component assembly. The assembly consists of two dissimilar but cooperating bowstring-mounted elements, and a circumscribing clamping ring. The assembly of the invention includes a pair of grommet-like rings or hubs each integrally formed with a coaxial tubular shank. Preferably, the hubs and the shanks of each component are slit longitudinally of the shank to enable one to mount the components on the bowstring without any need to detach the bowstring from the bow.

It is a critical feature of the nocking point assembly of the invention that the nocking elements define an inner, bow-string-engaging tubular member (of a shank and hub assembly) fabricated of a readily compressible and resilient elastomeric composition, and an outer, oversleeved tubular member or shank which, together with the integrally formed hub is of a harder composition and which exhibits high lubricity properties. The soft and resilient inner tubular shank frictionally grips and is fixedly secured to, in direct engagement with the bowstring, without causing physical damage to the bowstring. The hub of the second, outer shank and hub assembly is relatively hard and highly wear resistant to withstand repeated stressed contact with the arrow nock or with any mechanical release device used.

A split metal ring is positioned over the intersleeved tubular shanks to lock the assembly in a selectable position on the bowstring.

It will be appreciated that the present invention affords the advantages of a frictionally-secured bowstring-mounted nocking point of a readily compressible and resilient composition to protect the bowstring, and also the advantages of a nocking point of a harder composition and of high lubricity to resist the wear caused by repeated stressed engagement with the arrow nock or with an arrow release device. In the light of the teachings of the present invention those skilled in the art may readily select preferred compositions for the different but cooperating intersleevedly-mounted, physical elements.

Figure 1:
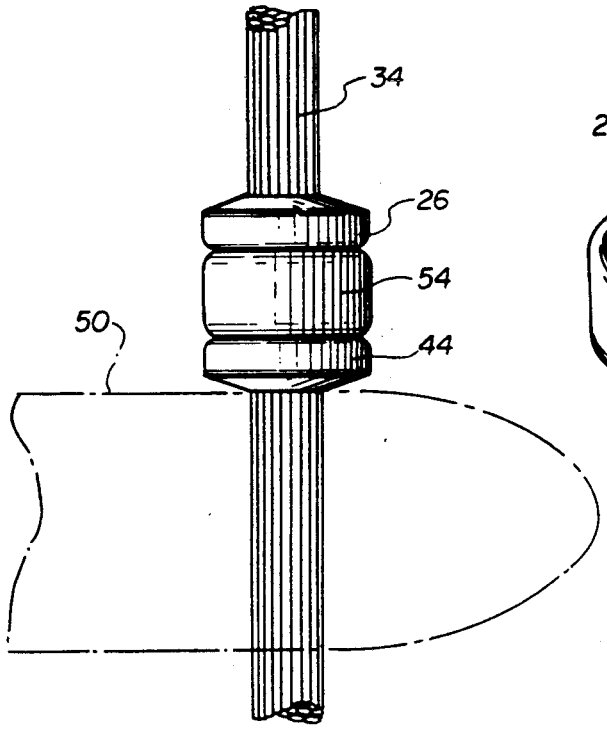
FIG. 1 is a front elevational view of a bowstring-mounted, 3-component nocking point assembly of the invention embodying the features thereof.
Figure 2:
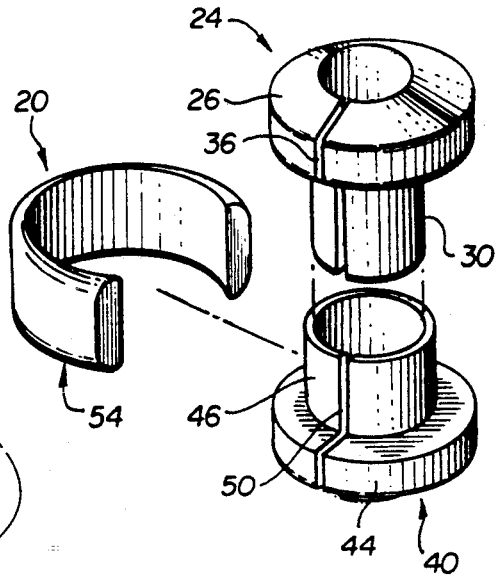
FIG. 2 is an exploded view of a nocking point assembly of the invention indicating schematically the manner of assembly of the intersleeved components and the clamping ring, the bowstring being omitted for clarity.
Figure 4:
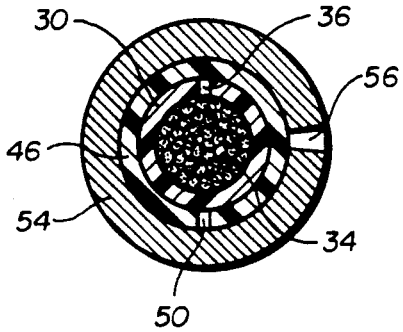
FIG. 4 is a cross-sectional view taken substantially on the lines 4—4 of FIG. 3 showing the staggering of the slits formed in the components of the nocking point assembly.
Figure 3:
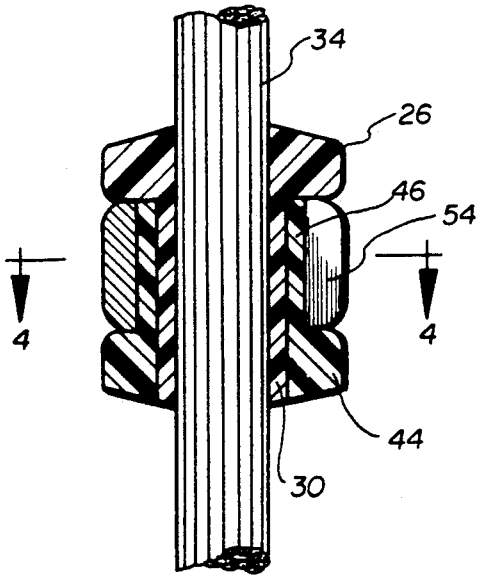
FIG. 3 is a cross-sectional view taken substantially on the lines 3—3 of FIG. 1 and showing the secured intersleeved interengagement of the three components of the nocking point assembly of the invention.

Referring now to the drawings, and more particularly to FIGS. 1, 2 and 3, for purposes of illustrative disclosure and not in any limiting sense, a preferred embodiment of the invention is shown as a nocking point assembly 20 consisting essentially of three components including an inner or first or grommet-like cushioning component 24 constituting a disc-like hub 26 integrally formed with a tubular shank 30. The shank 30 and the hub 26 are integrally formed of an elastomeric and compressible and resilient plastics or rubber or rubber-like composition for protecting and for frictionally gripping a bowstring 34 on which the cushioning component 24 of the assembly 20 is mounted. In the embodiment of the invention depicted, the hub 26 and the shank 30 are slit 36 lengthwise of the shank 30 to facilitate mounting of the component 24 on the bowstring 34 without detaching the bowstring 34 from the bow (not shown).

A second grommet-like component 40 of the assembly 20 is generally of the same physical configuration of the cushioning component 24 and includes a hub 44 from which projects a tubular shank 46, again, each being slotted 50. The inner diameter of the shank 46 is dimensioned slidingly and sleevedly to receive the shank 30 of the cushioning component 24 therewithin, as shown in FIG. 3. It is a critical feature of the invention that whereas the cushioning component 24 is of a softer and resilient or elastomeric composition, the lower or outer component 40 is of a harder and wear resistant material exhibiting lubricity to extend the useful life of that portion, for example, the hub 44 of the structure 40, which engages and bears against an arrow nock 50, or a release device, if used.

It will be appreciated that in assembling the device on the bowstring, the shank 30 of the upper, or inner, or cushioning element 24 is telescopically, sleevedly inserted within the enveloping shank 46 of the lower or wear-resisting element 40, as shown in FIG. 3. With the two hub-ended units in the position selected, along the length of the bowstring, a split metal ring 54 is forcibly crimped securely to embrace and lock upon the outer shank 46 stressingly to effect a positive, frictional engagement of the inner shank 30 with the bowstring 34 and to lock the assembly 20 in place, is indicated schematically (FIG. 3).

As shown in FIG. 3 the slots 36 and 50 in the inner and outer tubular shanks 30 and 46 and the associated hubs 26 and 44 are staggered or out of registry with one another and with the opening 56 in the locking band 54 to ensure a round cross-sectional configuration in the ringed zone 60.

Figure 5:
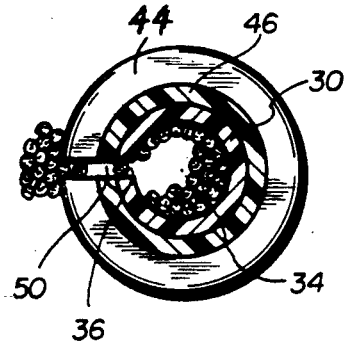
FIG. 5 is a cross-sectional view of the two intersleeved, non-metallic components of the nocking point assembly with the side-wall slots aligned and indicating schematically the manner in which the components are mounted on the bowstring.

The manner in which a multi-strand or multi-filament bowstring may be seated within the nocking set 20 of the invention is indicated schematically in FIG. 5. Rotation of the outer grommet-like component 40 to realize non-registry of the string entry openings or slots 36 and 50 is then carried out.

What is claimed is:

1. A nocking point assembly for attachment to an archery bowstring, said assembly comprising three separate components including first and second grommets and a split metal locking ring, each of said grommets consisting essentially of a split, disc-like hub integrally formed with a slit tubular shank, to provide, upon assembly of said components, inner and outer shanks in coextensive, intersleeved relationship, with lineally spaced-apart hubs, said inner of said shanks being formed of a plastics composition of a lesser hardness than that of said outer of said shanks to enhance non-slipping gripping engagement of said inner of said shanks with a bowstring to be embraced therewithin, and to provide effective wear resistance of said outer of said grommets during repeated contact of said hub thereof with a nock of an arrow drawn on the bowstring, and said locking ring being adapted for circumscribing bowstring-mounted said shanks of the intersleeved said grommets, in crimping engagement about the bowstring for securing said assembly fixedly in a selectable nocking locus on the bowstring.

2. The assembly as set forth in claim 1 wherein, in an assembled mode, said tubular shanks are of an annular orientation with respect to one another such that slits formed therein are rotationally displaced to avoid registery correspondence of said slits.

3. The assembly as set forth in claim 1 wherein, in an assembled mode of said grommets and said metal ring on a bowstring, the split in said metal ring is displaced annularly with respect to the slit in said outer shank of said grommets.

4. The assembly as set forth in claim 2, wherein, in an assembled mode of said grommets and said metal ring on a bowstring, the split in said metal ring is displaced annularly with respect to the slit in said outer shank of said grommets.

5. The assembly as set forth in claim 1, wherein said slits in said sleeved shanks and said split in said metal ring are staggered with respect to one another.

6. The assembly as set forth in claim 1, wherein said outer of said grommets is positioned lineally on the bowstring so as to be adjacent to for contacting abutment against any release device which may be used.

7. A nocking point assembly in accordance with claim 1 wherein said shank of said inner grommet is composed of a pressure-responsive and resilient elastomeric composition.

8. In a multi-component nocking point assembly comprising a pair of elements including a pair of coaxial, intersleeved tubular sections including an inner section for intimately embracing a bowstring on which said assembly is mounted, and including an outer component for abuttingly engaging a bowstring-mounted arrow nock, the improvement wherein said inner section comprises an elastomeric composition of lesser hardness and exhibiting compressibility and resilience for positively and protectively encasing and frictionally gripping a bowstring of an archery bow, and wherein said outer component constitutes a composition of greater hardness and of enhanced lubricity for abutting an arrow nock engaged on the bowstring thereby to reduce abrasive wear of said nocking point assembly against the arrow nock operationally seated on and drawn against the bowstring.

* * * * *